US007038561B2

(12) United States Patent
Esty

(10) Patent No.: US 7,038,561 B2
(45) Date of Patent: May 2, 2006

(54) DO-IT-YOURSELF GFI OUTLET KIT

(76) Inventor: Robert Esty, 5 Locke St., Falmouth, ME (US) 04105

( * ) Notice: Subject to any disclaimer, the term of this patent is extended or adjusted under 35 U.S.C. 154(b) by 0 days.

(21) Appl. No.: 10/945,501

(22) Filed: Sep. 20, 2004

(65) Prior Publication Data

US 2006/0061440 A1 Mar. 23, 2006

(51) Int. Cl.
*H01H 73/00* (2006.01)

(52) U.S. Cl. ..... 335/18; 439/538

(58) Field of Classification Search ..... 335/18; 361/42–51; 439/538
See application file for complete search history.

(56) References Cited

U.S. PATENT DOCUMENTS 6,120,320 A * 9/2000 Veiga et al. ..... 439/538

2002/0118498 A1* 8/2002 Nordling ..... 361/42

* cited by examiner

*Primary Examiner*—Lincoln Donovan
(74) *Attorney, Agent, or Firm*—William F. Hamrock

(57) ABSTRACT

A do-it-yourself, handy man kit for modifying a home duplex ground fault interrupter unit for insertion into a home duplex wall outlet electrical system. The kit includes an open top plastic housing, a set of blades and a ground prong, and two connecting mounting screws for securing together the modified ground fault interrupter unit and the home duplex wall outlet. A set of apertures in the housing bottom wall receive the blades and ground prong mounted on the ground fault interrupter unit for insertion into the wall outlet. The two connecting mounting screws are mountably projected through external indented channels on end walls of the housing secured to aligned tabs of the ground fault interrupter unit and the wall outlet. The kit overcomes the deficiencies experienced with prior systems in securing the ground fault interrupter to the duplex wall outlet.

5 Claims, 4 Drawing Sheets

DO-IT-YOURSELF GFI OUTLET KIT

FIELD OF THE INVENTION

The invention relates to a single and safe conversion of a home electrical system to a system having a ground fault interrupter circuit at electrical outlets by means of a handy man's do-it-yourself kit possessing elements which convert a home wire connecting ground fault interrupter to a ground fault interrupter unit which can be operationally and securely connected to home electrical outlets.

BACKGROUND OF THE INVENTION

Ground fault interrupter circuits (GFI) are well known. Typically, in a two wire home system, they detect possible hazardous unequal flow of current through one wire and open a switch to prevent further electrical flow. Many of the standard ground fault interrupters on the market are designed to be connected to wiring within an outlet box, as opposed to a more convenient and practical step of being connected to a standard electrical outlet allowing blades and a ground prong to be plugged into the outlet.

Recently, ground fault interrupter systems have been provided which plug into the electrical outlet without requiring rewiring of the outlet. U.S. Pat. No. 6,120,320 to Veiga et al, Pub. No. 2002/0118498A1 to Nordling, U.S. Pat. No. 4,079,344 to Lauben and US D486,792S to Stoughton are exemplary of these recent devices. However, there are no known simple and safe ground fault interrupter kits which a do-it-yourself person can use to convert the above standard wiring connector ground fault interrupter to a standard plug-in type home duplex electric wall outlet and obtain such a secured tight system as taught by this invention.

SUMMARY OF THE INVENTION

Objects of patentable novelty and utility taught by this invention are to provide a kit for modifying a GFI unit to simply and securely plug into standard duplex electrical wall outlets.

In accordance with the present invention, there is provided a low cost kit designed for modifying a standard GFI wiring system unit by a do-it-yourself person so that it can be plugged into conventional home duplex electrical wall outlet. The kit provides rectangular plastic open housing, a set of angled brass blades and an angled ground prong, and two connecting mounting screws. The rectangular open housing has interconnected side walls, end walls and bottom wall. Opposing indented channels embedded in the end walls enable the connecting mounting screws to extend through the channels for securing the unit to the housing and to the frame of the duplex wall outlet. The bottom wall is shaped and sized to fit flush and securely over a duplex wall outlet and is provided with receptacle apertures positioned and aligned with a set of blade and ground apertures in the standard duplex wall outlet. The set of angled blades and an angled ground prong in the kit are designed and structured to be secured to the set of blade screw terminal connecters and ground screw terminal connecter on the standard GFI unit. The GFI unit is then mounted within the open rectangular housing with the blades and ground prong extending through the bottom wall. The unit is connected to the upper section of the standard duplex electrical outlet.

BRIEF DESCRIPTION OF DRAWINGS

This invention is described by appended claims in relation to description of a preferred embodiment with reference to the following drawings which are explained briefly as follows:

DETAILED DESCRIPTION OF THE INVENTION

Listed numerically below with references to the drawings are terms used to describe features of this invention. These terms and numbers assigned to them designate the same features throughout this description.

Figure 1:
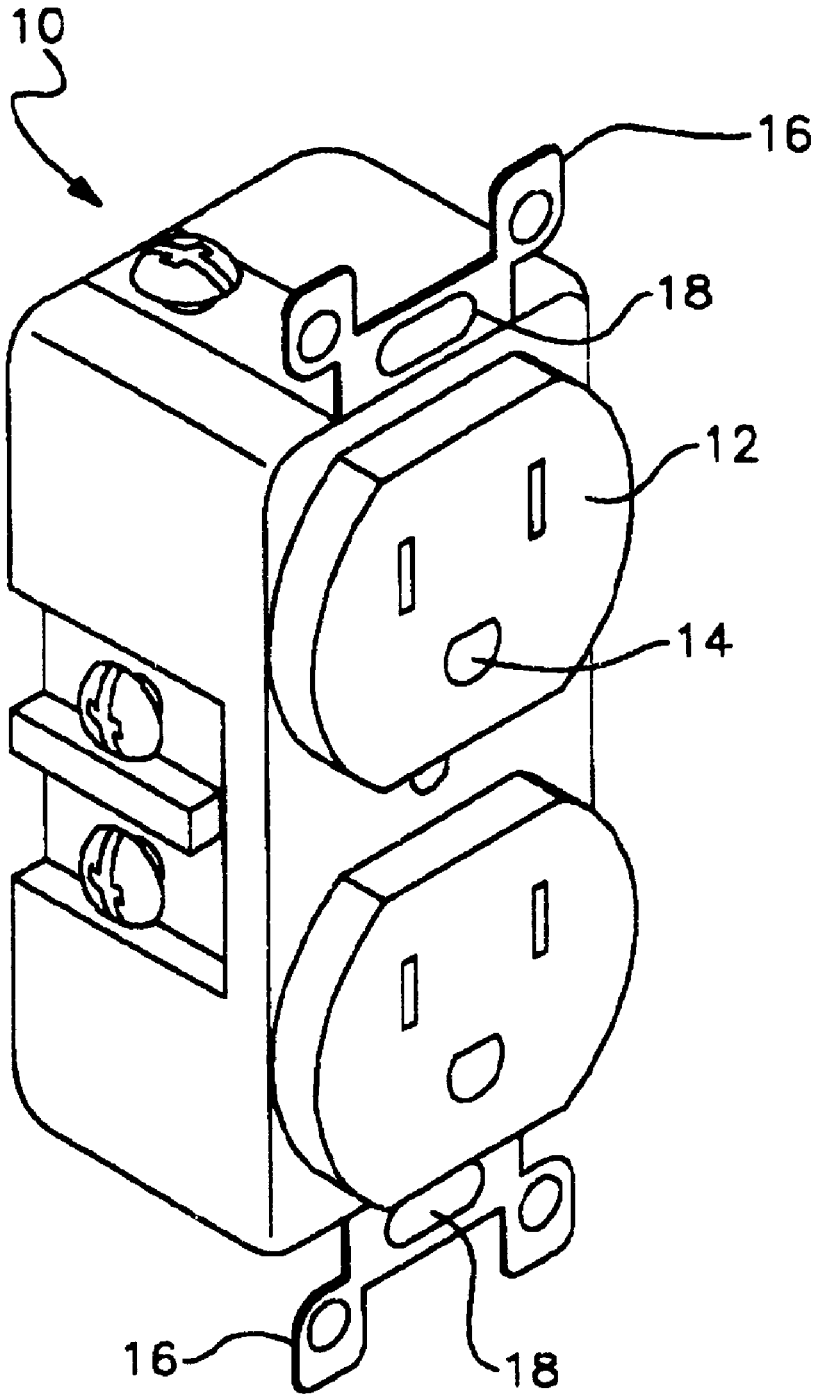
Fig. 1 (Prior Art)
FIG. 1 is a frontal view of a conventional electrical wall outlet.

10. Duplex electric wall outlet
12. Blade aperture
14. Prong ground aperture
16. Tabs
18. Opening
20. Duplex GFI unit
22. Blade screw
24. Ground screw
26. Tabs
28. Openings
30. Kit
32. Housing
34. Hollow body
36. Side wall
38. End wall
40. Bottom wall
42. Open top
44. Channel
46. Connecting mounting screw
48. Blade aperture
50. Ground aperture
52. Angled blades
54. Angled ground prong
56. Modified ground fault interrupter Referring to the drawings, FIG. 1 illustrates a frontal view of a standard home electrical duplex wall outlet, cover removed. Shown is the wall duplex outlet 10 with receptacle blade apertures 12 and prong ground aperture 14 for receiving a conventional appliance plug, not shown. Top and bottom tabs 16 include opening 18 through which small screws attach to a wall duplex outlet frame.

Figure 2:
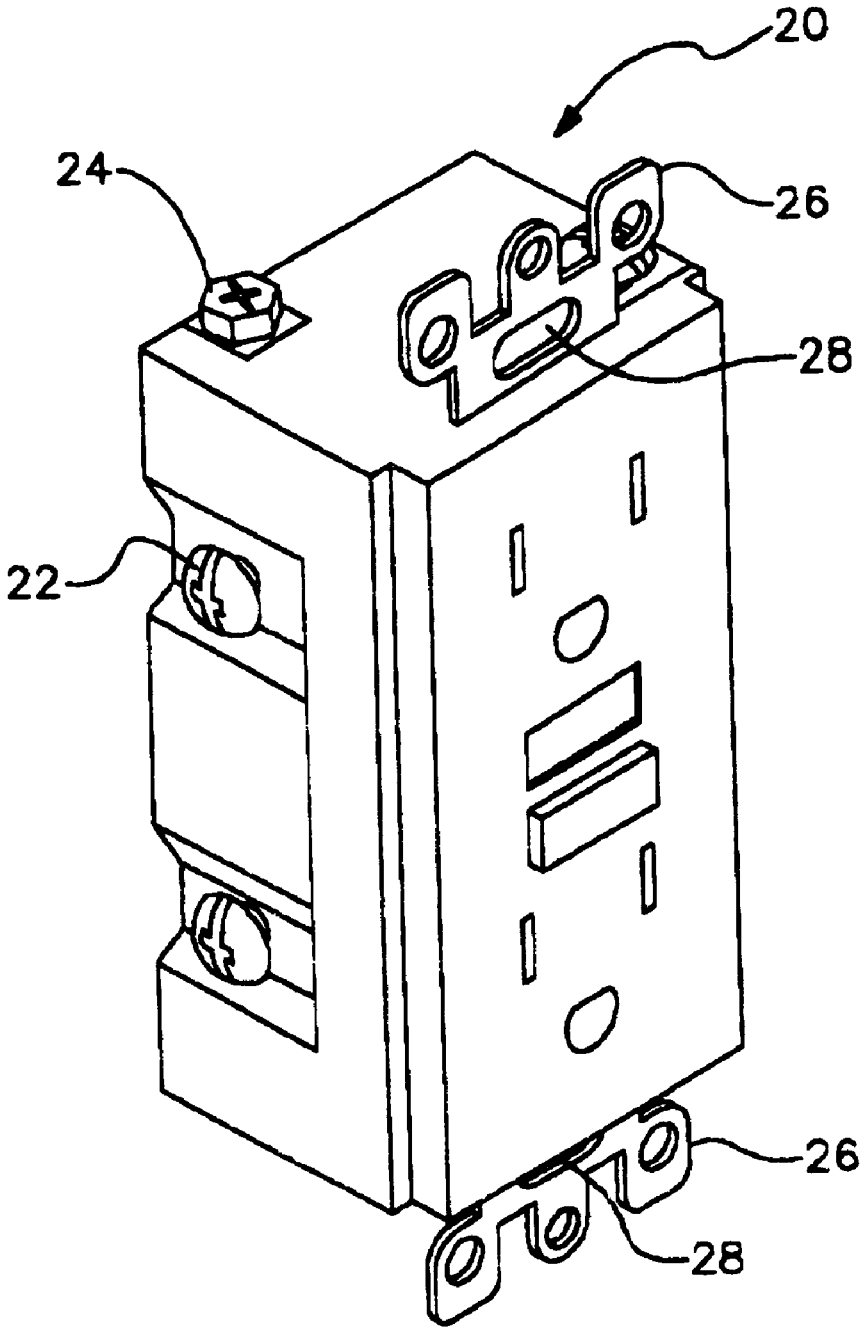
Fig. 2 (Prior Art)
FIG. 2 is a perspective view of a standard wire connecting GFI unit.

Shown in FIG. 2 is a standard home duplex GFI unit 20 which has two sets of screw terminal connections 22 and a ground screw terminal connection 24 to be attached to corresponding sets of wires within a standard GFI wall outlet box, not shown. Top and bottom GFI unit tabs 26 include opposing openings 28 through which small screws attach to a wall outlet, not shown.

Figure 3:
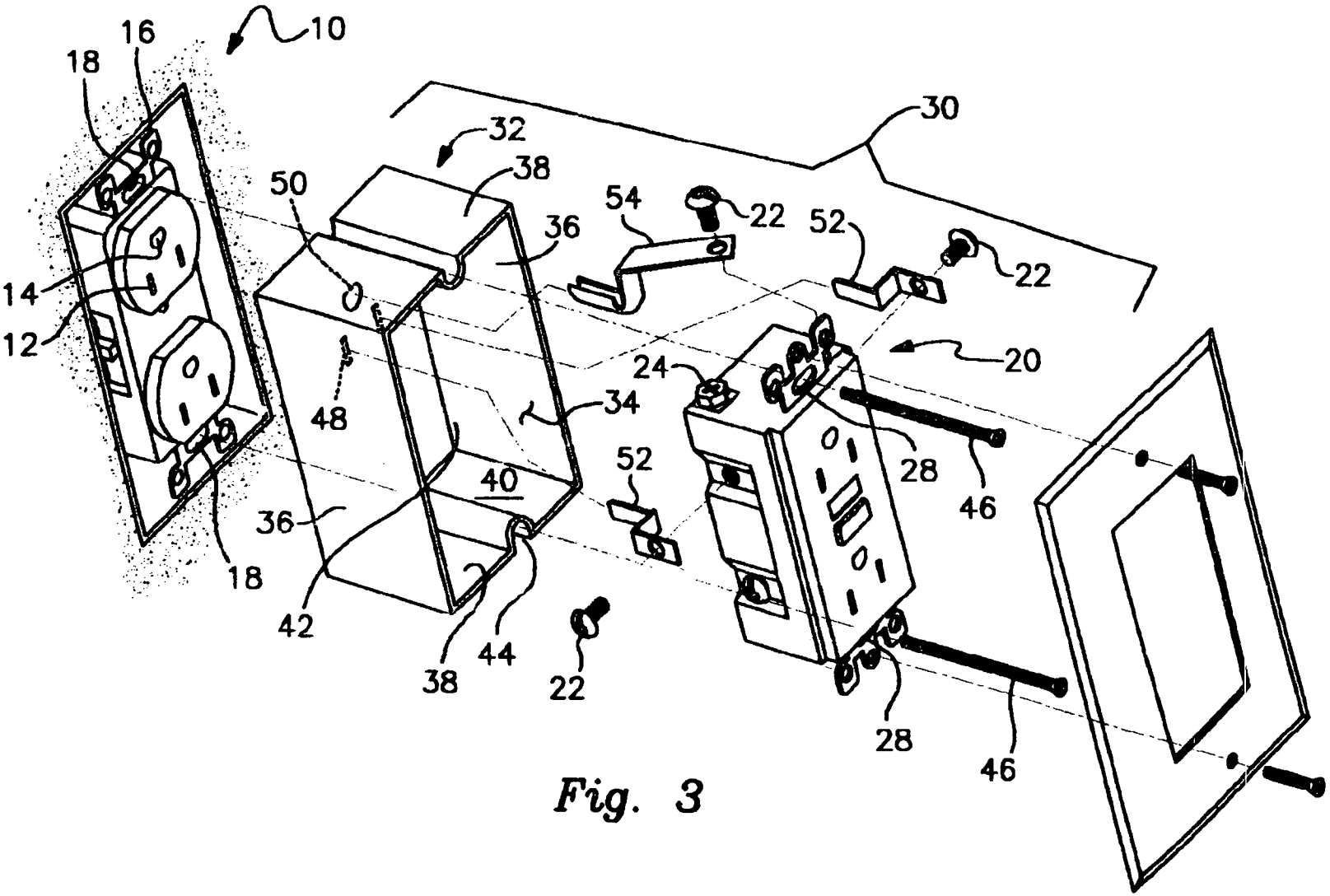
FIG. 3 is an exploded view of the GFI kit of the invention.

In order to modify the standard duplex GFI unit of the invention to electrically engage the standard duplex home electric outlet 10, a kit 30 is provided as seen in the exploded view in FIG. 3. The kit embodies rectangular plastic housing 32, two connecting long mounting screws 46, two angled metal blades 52 and angled metal ground prong 54. The kit in FIG. 3 is shown attachable to top sections of the duplex wall outlet 10 and duplex GFI unit 20. The rectangular plastic housing 32 has a hollow body 34 with interconnected side walls 36, end walls 38, bottom wall 40 and an open top 42. The exterior of each end wall 38 is provided with an opposing indented channel 44 extending downwardly which will enclose connecting mounting screws 46 to securely lock the enclosed GFI unit 20 in housing 32 to duplex home outlet 10 with its cover removed. Bottom wall 40 is provided with two blade apertures 48 and ground prong aperture 50 which are positioned and structured to align with, and to engage, the blade 12 and ground 14 apertures of wall duplex electrical outlet 10.

Figure 4:
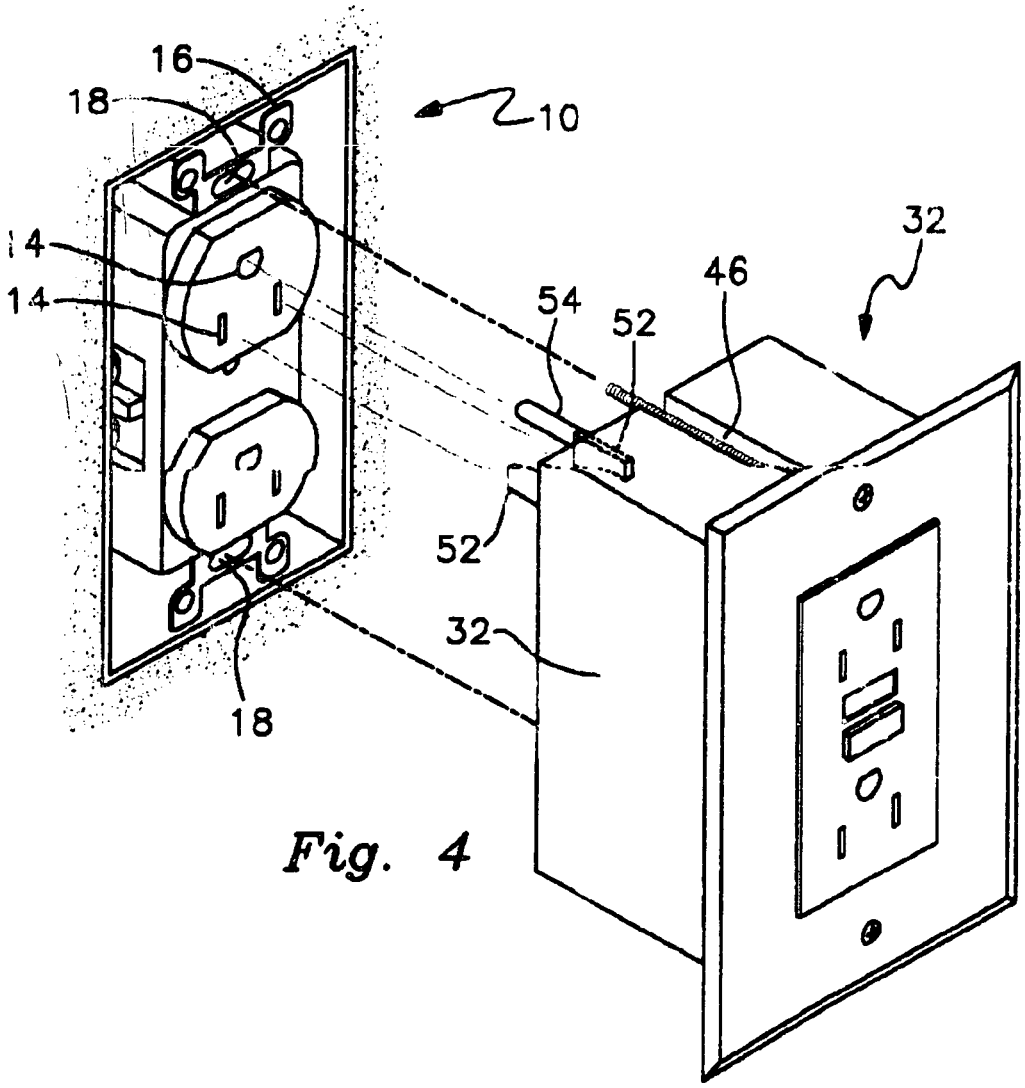
FIG. 4 is a view of the kit modified ground fault interrupter unit and electrical wall outlet.
Figure 5:
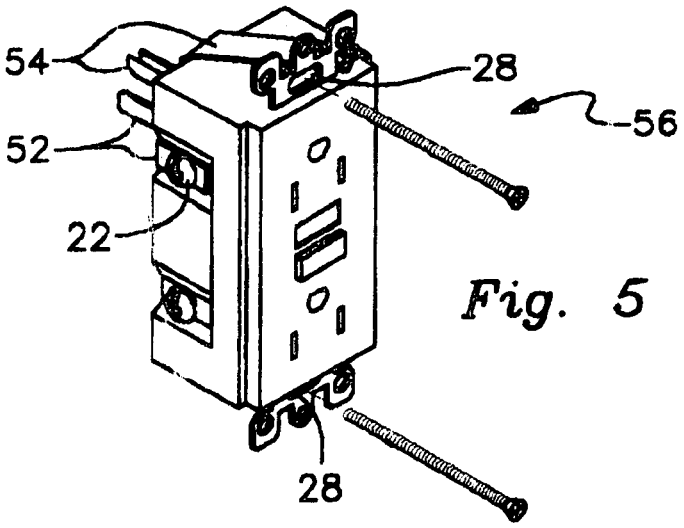
FIG. 5 is a view of the GFI unit with the angled blades and angled ground prong attached to blade and ground screws.

Shown in FIG. 3 are connector elements of the invention in the form of two individual angled blades 52 and angled ground prong 54 and two connecting mounting screws 46. The angled blades and angled ground prong are designed and structured to be secured to the set of corresponding screw terminal connections blade screws 22 and ground screw 24 on the standard GFI unit 20. As shown in FIGS. 4 and 5, GFI unit 20 with angled blades and angled ground attached to screw terminals 22 and 24 is mounted within the hollow body 34 of plastic housing 32 with the connector blades 52 and prong 54 to be plugged into the corresponding blade and prong apertures 48 and 50 of the bottom wall 40. As indicated in FIG. 4, the unit in housing 32 is adapted to be received flush and secured in the top set of receptacle blade 12 and ground 14 apertures overlapping the duplex wall outlet 10.

The ground fault interrupter kit 30 of the invention also includes further connector elements in the form of two connecting mounting screws 46 as discussed. Once the modified GFI is plugged into duplex wall outlet 10, the entire structure is tightly and firmly secured together by means of connecting mounting screws 46 which are inserted through opening 28 of GFI tab 26, passing through channel 44 and secured within opening 18 of duplex wall outlet tab 16. This overcomes deficiencies of prior GFI systems which have difficulty firmly securing the system to the duplex electric wall outlets.

Having now described the invention in detail in accordance with the requirements of the patent statutes, those skilled in the art will have no difficulty in making changes and modifications in the individual parts or their relative assembly in order to meet specific requirements or conditions. Such changes and modifications may be made without departing from the scope and spirit of the invention, as set forth in the following claims.

What is claimed is:

1. A do-it-yourself kit for modifying a home duplex GFI unit, having screw terminal connections and attached tabs, in order to plug into a home duplex wall outlet, having attached tabs comprising, a plastic rectangular open top housing having interconnected opposing sidewalls, opposing end walls and a bottom wall providing a set of apertures, sized and shaped to contain the GFI unit and to connect the GFI unit and fit flush-and-tightly on and overlap the duplex wall outlet, a set of two angled metal blades and an angled metal ground prong, sized and shaped for mounting to the GFI unit's screw terminal connections, two connecting mounting screws sized and shaped to secure the GFI unit and the wall outlet firmly together.

2. The kit according to claim 1 wherein the bottom wall set of apertures is positioned and sized for receiving the set of two blades and ground prong.

3. The kit according to claim 2 wherein the set of angled blades and angled ground prong are attachable to the screw terminal connections on the GFI unit for extending through the set of apertures in the bottom wall of the housing.

4. The kit according to claim 3 wherein the GFI unit is mountable within the open top housing to be plugged into the duplex wall outlet.

5. The kit according to claim 4 wherein the two connecting mounting screws are mountable within the GFI tabs for projecting through the indented channels of the end walls and locking into the tabs of the wall outlet.

* * * * *